US006320314B1

(12) United States Patent
Torikai et al.

(10) Patent No.: US 6,320,314 B1
(45) Date of Patent: Nov. 20, 2001

(54) ELECTRICITY INTRODUCING MEMBER FOR VESSELS

(75) Inventors: Tetuya Torikai, Fukuoka; Yukiharu Tagawa, Himeji, both of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/269,757

(22) PCT Filed: Sep. 8, 1998

(86) PCT No.: PCT/JP98/04012

§ 371 Date: Apr. 7, 1999

§ 102(e) Date: Apr. 7, 1999

(87) PCT Pub. No.: WO99/13493

PCT Pub. Date: Mar. 18, 1999

(30) Foreign Application Priority Data

Sep. 8, 1997 (JP) ..... 9-258000

(51) Int. Cl.[7] ..... H01J 61/36
(52) U.S. Cl. ..... 313/625; 313/332
(58) Field of Search ..... 313/623, 624, 313/625, 332

(56) References Cited

U.S. PATENT DOCUMENTS

| | | | | |
|---|---|---|---|---|
| 4,881,009 | | 11/1989 | Passmore | 313/633 |
| 5,861,714 | * | 1/1999 | Wei et al. | 313/625 |
| 6,107,740 | * | 8/2000 | Morimoto et al. | 313/625 |
| 6,175,188 | * | 1/2001 | Morimoto et al. | 313/625 |
| 6,194,832 | * | 2/2001 | Juengst | 313/623 |

FOREIGN PATENT DOCUMENTS

| | | | | |
|---|---|---|---|---|
| 0 650 184 | | 4/1995 | (EP) | H01J/61/36 |
| 1 043 754 | * | 11/2000 | (EP) | H01J/61/36 |
| 10-175514 | | 6/1998 | (JP) | H01J/61/36 |
| 10-188897 | | 7/1998 | (JP) | H01J/61/36 |
| 10-280009 | | 10/1998 | (JP) | H01J/9/32 |
| 10-289691 | | 10/1998 | (JP) | H01J/61/36 |

OTHER PUBLICATIONS

Patent Abstracts of Japan, vol. 1998, No. 10, Aug. 31, 1998, JP 10 125284 A, Toto Ltd., May 15, 1998, English Abstract.

* cited by examiner

*Primary Examiner*—Michael H. Day
(74) *Attorney, Agent, or Firm*—Nixon Peabody LLP; David S. Safran

(57) ABSTRACT

An electricity introducing member for a tube lamp includes a closing member and an electrode upholding part formed integrally together; the closing member includes a plurality of layers each comprising a conductive component and silica, the volumetric proportion of the silica being n1, n2, n3, . . . , nx such that n1>n2>n3> . . . >nx, are successively laminated in the form of a cylinder, so that the closing member serves as a functional gradient material; where the diameter of the closing member is D in mm and the total thickness of the laminate of the layers each containing more than 80 volume % of silica is L in mm; L/D is not less than 2: the electrode upholding part is shrink-fitted from the surface on the side of the layer n1 up to the layer containing at most 80 volume % of silica in the closing member. Preferably, where the diameter of the electrode upholding part is d in mm, the ratio of d/D is from 0.12 to 0.6.

2 Claims, 3 Drawing Sheets

| NO. | D (mm) | L/D | d (mm) | d/D | tip position | functional gradient material | |
|---|---|---|---|---|---|---|---|
| | | | | | | bending as fault | crack formation |
| 1 | 2.5 | 3.8 | 0.3 | 0.12 | n10 (82.3% Silica) | bending formed | ○ |
| 2 | 2.5 | 3.8 | 0.3 | 0.12 | n11 (80% Silica) | ○ | ○ |
| 3 | 2.5 | 3.8 | 0.3 | 0.12 | n12 (75.6% Silica) | ○ | ○ |
| 4 | 2 | 4.75 | 0.6 | 0.3 | n11 (80% Silica) | ○ | ○ |
| 5 | 2 | 4.75 | 1.2 | 0.6 | n11 (80% Silica) | ○ | ○ |
| 6 | 2 | 4.75 | 1.6 | 0.8 | n11 (80% Silica) | ○ | cracks in silicon dioxide area |
| 7 | 3 | 3.2 | 0.5 | 0.17 | n10 (82.3% Silica) | bending formed | ○ |
| 8 | 3 | 3.2 | 0.5 | 0.17 | n11 (80% Silica) | ○ | ○ |
| 9 | 3 | 3.2 | 0.3 | 0.1 | n12 (75.6% Silica) | bending formed | ○ |
| 10 | 3 | 3.2 | 1.6 | 0.53 | n11 (80% Silica) | ○ | ○ |
| 11 | 4 | 2.4 | 1.6 | 0.4 | n12 (75.6% Silica) | ○ | ○ |

Fig.5

ELECTRICITY INTRODUCING MEMBER FOR VESSELS

TECHNICAL FIELD

The invention relates to an electrical inlet body for a tube lamp, such as a discharge lamp, a halogen lamp, or the like.

DESCRIPTION OF THE RELATED ART

In a discharge lamp in which there are a pair of electrodes opposite one another, recently functional gradient material has been increasingly used as a sealing arrangement. In a sealing body of this functional gradient material one side is rich in a dielectric component and in the direction to the other side the proportion of electrically conductive component increases continuously or incrementally. A one-part arrangement of this functional gradient material with upholding parts of the electrodes is called the "electrical inlet body".

In a functional gradient material in which as the dielectric component silicon dioxide is used and as the electrically conductive component molybdenum is used, the silicon dioxide end has a coefficient of thermal expansion which is roughly equal to the coefficient of thermal expansion of the silicon dioxide which forms the arc tube, while the molybdenum end has the property that its coefficient of thermal expansion approaches the coefficient of thermal expansion of the tungsten or molybdenum which forms the upholding parts of the electrodes. These properties are suitable for a sealing body of a discharge lamp.

A functional gradient material as the sealing body can also be used not only for a discharge lamp, but also for a halogen lamp provided with a luminous filament or a halogen heating apparatus provided with a filament because the arc tube consists of silica glass.

The process for producing one such functional gradient material is disclosed for example in Japanese patent disclosure document HEI 8-138555.

DISCLOSURE OF THE INVENTION

As claimed in the invention an electrical inlet body described below for a tube lamp is given:

(1) The invention is characterized in an electrical inlet body for a tube lamp in that a functional gradient material of an electrically conductive component and silicon dioxide is used as the dielectric component, that several combined layers are placed on top of one another cylindrically and incrementally, the volumetric ratio (%) of silicon dioxide in this functional gradient material being designated n1, n2, n3, . . . , nx (n1>n2>n3> . . . nx), that furthermore L/D≧2, when the diameter of this cylindrical functional gradient material is labelled D (mm) and the total thickness of the combined layers with a volumetric ratio of silicon dioxide of greater than 80% is labellea L (mm), and that the upholding parts of the electrodes proceeding from the side of the n1 layer are shrunk as far as the combined layers with a volumetric ratio of silicon dioxide of at least less than or equal to 80%.

(2) The invention is furthermore characterized in that for (1) d/D is in the range from 0.12 to 0.6 , when the diameter of the electrode carrier is labeled d (mm).

BRIEF DESCRIPTION OF THE DRAWING

FIG. 5 shows a schematic of the result of a visual check of the state of a complete electrical inlet body for a tube lamp.

BEST MODE FOR CARRYING OUT THE INVENTION

Figure 1:
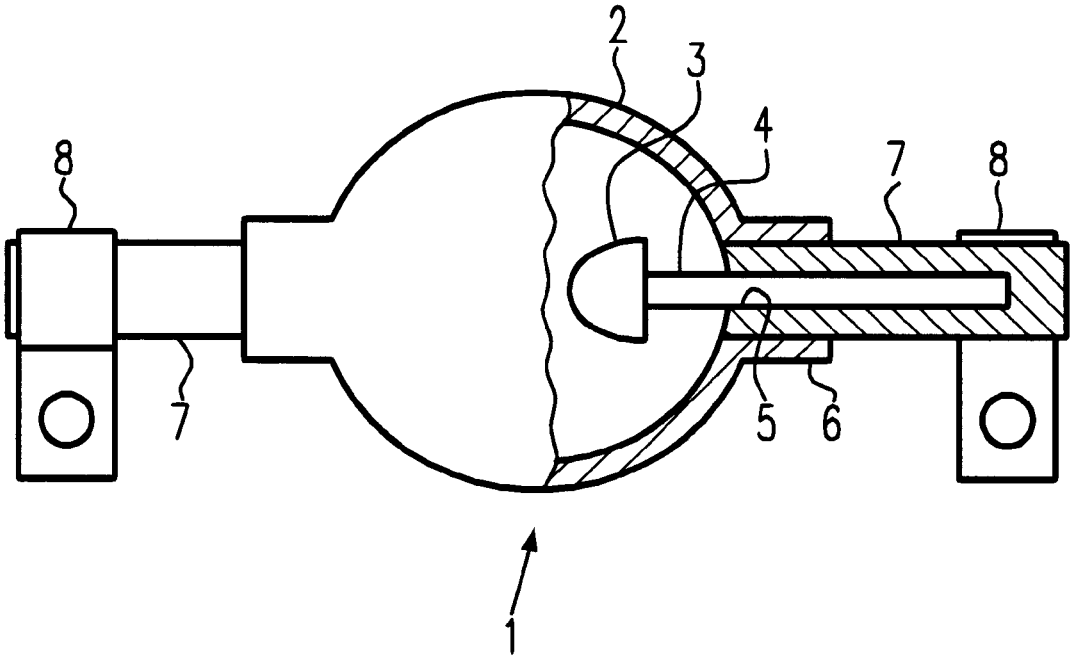
FIG. 1 shows a schematic partial cross section of a discharge lamp for which a functional gradient material is used.

FIG. 1 schematically shows a discharge lamp for which the above described functional gradient material is used. In the figure reference number 1 labels a discharge lamp with an arc tube 2 and sealing tube 6 consisting of silica glass.

In arc tube 2 there is a pair of electrodes 3 opposite one another. Reference number 7 labels a sealing body which is cylindrical and which consists of silicon dioxide and molybdenum. One end of the sealing body 7 (the side towards the arc tube) is rich in silicon dioxide and dielectric, while the other end (the side away from the arc tube) is rich in molybdenum and electrically conductive. This means that the sealing body 7 is a functional gradient material.

The dielectric face of the sealing body 7 is adjacent to the discharge space of the discharge lamp. The sealing tubes 6 formed on the two ends of the arc tube 2 are hermetically welded in the areas of the sealing body 7 which are rich in silicon dioxide, that is, in the dielectric areas. Reference number 8 labels a metal strip.

Figure 2:
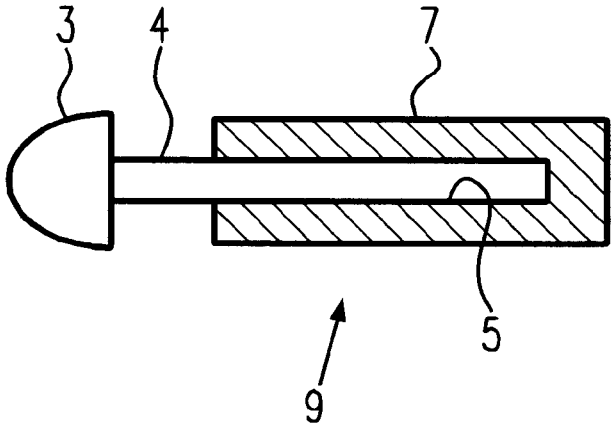
FIG. 2 shows a schematic cross section of an electrical inlet body for a tube lamp.

FIG. 2 schematically shows an electrical inlet body for a tube lamp for which one such functional gradient material is used, in cross section. The expression "electrical inlet body" is defined as a one-part arrangement of the sealing body consisting of functional gradient material with the upholding parts of the electrodes.

In the production of the functional gradient material however in practice within one layer after the pressing process nonuniformities and density gradients often occur. If in this state complete sintering is done, there are cases in which the overall shape is bent or the cross section no longer remains circular.

Figure 3:
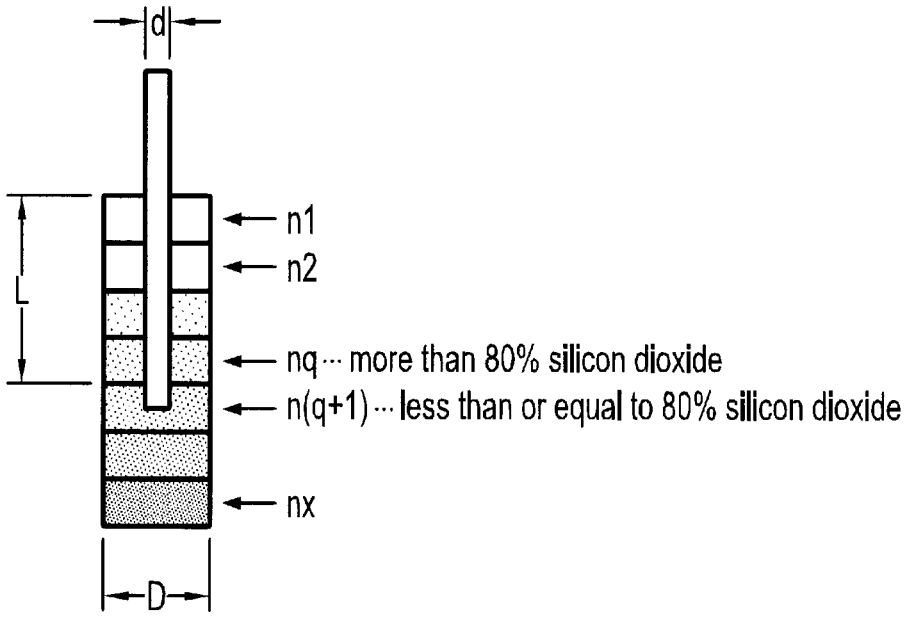
FIG. 3 shows a schematic which details an electrical inlet body as claimed in the invention.

The important feature of the invention lies in eliminating this defect. FIG. 3 is a schematic of an electrical inlet body by which the invention is detailed.

In this electrical inlet body the layers are placed on top of one another in rows, the volumetric ratio (%) of silicon dioxide being labelled n1, n2, n3, . . . , nx (n1>n2>n3> . . . nx). The combined layers are continuously staggered from the electrically conductive component to the dielectric component.

Among the layers n1 to nx on top of one another, layers n1 to nq have a volumetric ratio of silicon dioxide of greater than 80%, while layers n(q+1) to nx have a volumetric ratio of silicon dioxide of less than or equal to 80%. Reference letter D labels the diameter of the respective layer or the sealing body and reference letter L labels the entire thickness of the superimposed homogenous layers (n1 to nq) with a volumetric ratio of silicon dioxide of greater than 80%.

Conventionally, when a functional gradient material is used for the sealing body of a tube lamp, molybdenum is often used as the electrically conductive component and silicon dioxide as the dielectric component. In this embodiment a combination of molybdenum with silicon dioxide is also used.

Figure 4:
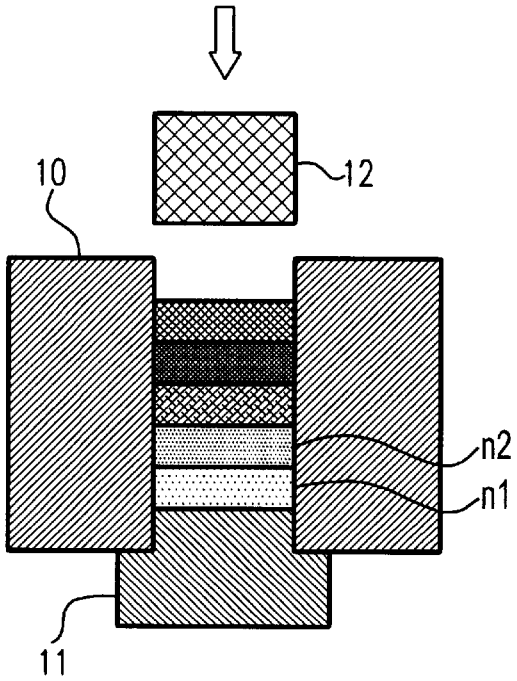
FIG. 4 shows a schematic of the pressing process in the formation of a functional gradient material.

In the following the production process is described:

A silicon dioxide powder is mixed with molybdenum powder such that the content is different;

The respective mixed powder is mixed using a ball mill. In this way several mixed powders are produced in which the contents differ from one another;

Using this mixed powder a mixed powder with the lowest molybdenum concentration as the layer is inserted from a bottom component 11 of a casting mold 10 provided with a cylindrical mold space, by which the n1 layer is formed, as is shown in FIG. 4. Then, by introducing the mixed powder with the second lowest molybdenum concentration layer by layer the n2 layer is formed.

In this sequence mixed powders with altered molybdenum concentrations are inserted layer by layer in the required number of layers and afterwards pressed and molded by a press body 12. In this way a layer structure is formed in which several formed layers are placed in one piece on top of one another. FIG. 4 feasibly shows a state with five layers.

After formation of the layer structure in this way temporary sintering is done.

The silicon dioxide-rich face of this layer structure is provided with insertion openings for the upholding parts of the electrodes. Afterwards the upholding parts of the electrodes are inserted into the openings and complete sintering is done. In the following the invention is described using examples of numerical values.

One example is described in which an electrical inlet body as claimed in the invention is used for a metal halide lamp of the short arc type.

A molybdenum powder with an average grain size of 1.0 micron and a silicon dioxide power with an average grain size of 5.6 microns were prepared and 17 different mixed powders each with an altered volumetric ratio of silicon dioxide were produced.

Then the respective mixed powder was mixed with stearic acid (a solution with roughly 23%), by which one granulate at a time was obtained.

In the granulate the volumetric ratio (%) of silicon dioxide in the case of n1 is 100, n2 it is 99.5, n3 98.9, n4 98.3, n5 97.7, n6 94.9, n7 91.6, n8 87.7, n9 86.4, n10 82.3, n11 80.0, n12 75.6, n13 60.8, n14 53.7, n15 45.0, n16 34.0, and n17 19.6, when n1, n2, n3, . . . n17 in the sequence of greater volumetric ratio are assigned to a smaller volumetric ratio of silicon dioxide.

In the sequence of n1, n2, n3, . . . to n17 the cylindrical casting mold 10 was filled with these granulates as shown in FIG. 4. The granulates were compressed by the press body 12 with a load of 6 t/cm$^2$ in the axial direction, a cylindrical compacted body having been obtained.

The thickness (mm) of the respective compressed layer after molding in the case of n1 was 2.0, n2 to n3 1.0, n4 to n10 0.5, n11 to n16 0.7 and n17, 2.

The compacted bodies were sintered in hydrogen gas at 1200° C. for 30 minutes In this way the organic binder was removed.

The above described average grain sizes of the molybdenum powder and the silicon dioxide powder, the conditions for removal of the organic binder, the amount of loading in the molding of the functional gradient material and the like are not limited to the above described conditions.

Next, the faces of the functional gradient material on the n1 side were provided with insertion openings for the upholding parts of the electrodes. Then the tungsten upholding parts of the electrodes were inserted and sintered for five minutes in a vacuum atmosphere at 1820° C. Thus complete sintering was done to shrink the upholding parts of the electrodes.

In the above described production process the functional gradient material with a diameter of 2 mm, 2.5 mm, 3 mm and 4 mm was combined with tungsten upholding parts of the electrodes with a diameter of 0.3 mm, 0.5 mm, 0.6 mm, 1.2 mm and 1.6 mm. Thus one electrical inlet body at a time was produced.

It was visually checked and confirmed whether in the above described respective electrical inlet body there are disadvantages or not. Here, checking was done with respect to the diameter D of the functional gradient material, the total thickness of L of the combined layers with a volumetric ratio of silicon dioxide in the axial direction of the functional gradient material of greater than 80%, L/D, the diameter d of the upholding parts of the electrodes, d/D, and the tip position of the of the upholding parts 4 of the electrodes in the functional gradient material, which in FIG. 3 is shown in about the middle of the first region in which the amount of silicon dioxide does not exceed 80%. FIG. 5 shows the result using a table.

The table in FIG. 5 shows that, for No. 1 and No. 7, in the electrical insertion bodies with a value L/D of greater than or equal to 2, the upholding parts of the electrodes with complete sintering of the functional gradient material could not support deformation as a result of nonuniformities of the density within the layer and as a result of softening of the functional gradient material, and bending-as-fault occurred, in No. 1 and No. 7, where the tips of the upholding parts of the electrodes in the functional gradient not reaching the layers with a volumetric ratio of silicon dioxide of less than or equal to 80%.

In the electrical inlet body No. 9 in which d/D is less than or equal to 0.12, the upholding parts of the electrodes were too thin. They were not able to support frictional gradient material, by which likewise bending as faults occurred. In electrical inlet body No. 6 in which d/D is greater than 0.6, cracks formed in the areas of the functional gradient material which are rich in silicon dioxide.

In the above described embodiment two tungsten carriers were used as the upholding parts of the electrodes. However the same result can be obtained when molybdenum is used.

As was described above, as claimed in the invention the upholding parts of the electrodes of tungsten or molybdenum are shrunk up to the layers with a volumetric ratio of silicon dioxide of the cylindrical functional gradient material of less than or equal to 80%. This measure prevents bending and cracking in the functional gradient material. Thus, an electrical inlet body for a tube lamp can be obtained which can be reliably welded to the silica glass sealing tube of the tube lamp.

Furthermore, by the measure that d/D, i.e. the relation between the diameter d (mm) of the upholding parts of the electrodes and the diameter D (mm) of the cylindrical functional gradient material, is in the range from 0.12 to 0.6, an electrical inlet body for a tube lamp is obtained which can be reliably welded to the silica glass sealing tube of the tube lamp without bending and cracking in the functional gradient material.

COMMERCIAL APPLICATION

As was described above, the electrical inlet body as claimed in the invention can be used for a tube lamp such as a metal halide lamp, a mercury lamp or the like, and for a filament lamp such as a halogen lamp or the like.

What is claimed is:

1. An electricity introducing member for a tube lamp comprising: a closing member and an electrode upholding part formed integrally together; the closing member includes a plurality of layers each comprising a conductive component and silica, the volumetric proportion of the silica being n1, n2, n3, . . . , nx such that n1>n2>n3> . . . >nx, are successively laminated in the form of a cylinder, so that the closing member serves as a functional gradient material; where the diameter of the closing member is D in mm and the total thickness of the laminate of the layers each containing more than 80 volume % of silica is L in mm; L/D is not less than 2; the electrode upholding part is shrink-fitted from the surface on the side of the layer n1 up to the layer containing at most 80 volume % of silica in the closing member.

2. Electrical inlet body for a tube lamp as claimed in claim 1, wherein d/D is in the range from 0.12 to 0.6, when the diameter of the electrode carrier is labeled d (mm).

* * * * *